United States Patent [19]

Cuschera

[11] Patent Number: 4,562,602

[45] Date of Patent: Jan. 7, 1986

[54] FLOOR DRAIN WITH WASTE PIPE REDUCTION

[76] Inventor: Casper Cuschera, 1047 - 77th Ave., Oakland, Calif. 94621

[21] Appl. No.: 644,637

[22] Filed: Aug. 27, 1984

[51] Int. Cl.[4] ..... E03C 1/26

[52] U.S. Cl. ..... 4/288; 4/286; 4/292; 285/158; 285/159; 285/161

[58] Field of Search ..... 4/286, 288, 292, 289, 4/291, 290; 285/156, 158, 159, 160, 161

[56] References Cited

U.S. PATENT DOCUMENTS

| | | | |
|---|---|---|---|
| 3,509,587 | 5/1970 | Fins | 4/288 |
| 3,742,525 | 7/1973 | Oropallo | 4/288 |
| 3,813,708 | 6/1974 | Hamburg | 4/288 X |
| 3,831,983 | 8/1974 | Stickler | 285/156 |
| 3,952,340 | 4/1976 | Cuschera | 4/288 X |
| 4,067,072 | 1/1978 | Izzi | 4/288 |
| 4,090,267 | 5/1978 | Cuschera | 4/288 |
| 4,146,939 | 4/1979 | Izzi | 4/288 X |
| 4,405,159 | 9/1983 | Spelber | 285/158 X |

*Primary Examiner*—Henry K. Artis

*Attorney, Agent, or Firm*—Harris Zimmerman; Howard Cohen

[57] ABSTRACT

A wide floor drain which is adapted to fit a narrow waste pipe includes a wide drain body having an upper flange extending radially outwardly from the upper end thereof and disposed generally flush with a floor surface. The drain body includes external threads which secure an upper exterior nut adapted to compressively engage the underside of the floor. A wide lower flange extending radially inwardly from the lower end defines a narrow bore. A tubular coupling member extends through the lower bore, and includes an upper coupling flange which is dimensioned to be disposed directly superjacent to the lower flange of the drain body. The coupling member also includes exterior threads which secure a lower exterior nut adapted to impinge upon the exterior of the lower flange. Packing means are disposed between the coupling flange and the lower body flange, and between the lower body flange and the lower nut, so that the lower nut may compressively seal the coupling member and the drain body at the lower bore opening. The lower end of the coupling member is securable to a narrow waste pipe. A plurality of coupling members may be provided to facilitate connection to waste pipes of differing diameters.

8 Claims, 3 Drawing Figures

FLOOR DRAIN WITH WASTE PIPE REDUCTION

BACKGROUND OF THE INVENTION

In the plumbing supply industry many standard items are produced in a range of standard sizes or diameters. More specifically, a line of floor drains may include drains of widely varying diameters in order to suit a wide range of drainage demands. Likewise, waste pipe also is available in a series of diameters (and materials), to meet widely differing needs. However, large diameter floor drains generally are designed to connect to large diameter waste pipes, since this is their most common use. Unfortunately, it is therefore difficult to connect a large diameter drain, when required, to a piping system which uses narrow waste pipe. Although standard reduction coupling members are available, there is often insufficient space available to make use of such devices in the cramped area between ceiling and floor structures. Thus either a smaller, less suitable drain must be specified, or the larger pipe must be run to a point where there is space for the reduction coupler. In either case the resulting plumbing job is less than optimum.

SUMMARY OF THE PRESENT INVENTION

The present invention generally comprises a wide floor drain which is adapted to fit a narrow waste pipe. The invention includes a large diameter cylindrical drain body having an upper flange extending radially outwardly from the upper end thereof and disposed generally flush with a floor surface. The drain body includes external threads which secure an upper exterior nut adapted to compressively engage the underside of the floor. A wide lower flange extending radially inwardly from the lower end defines a narrow lower bore. A tubular coupling member extends through the lower bore, and includes an upper coupling flange extending radially therefrom which is dimensioned to be disposed directly superjacent to the lower flange of the drain body.

The coupling member also includes exterior threads which secure a lower exterior nut adapted to impinge upon the exterior of the lower flange. Packing rings are disposed between the coupling flange and the lower body flange, and between the lower body flange and the lower nut, so that the lower nut may compressively seal the coupling member and the drain body at the lower bore opening. The lower end of the coupling member is securable to a narrow waste pipe, using standard techniques.

DESCRIPTION OF THE PREFERRED EMBODIMENT

Figure 1:
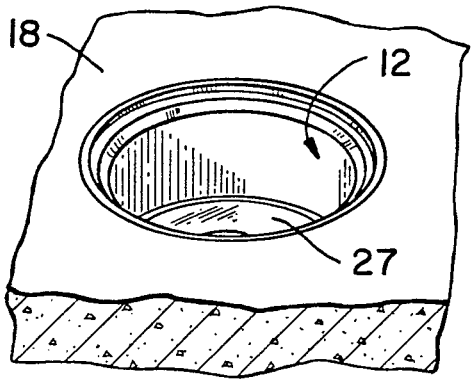
FIG. 1 is a perspective view of the drain member of the present invention installed in a floor.

The present invention generally comprises a wide diameter drain fitting which is particularly designed to be connected to a waste pipe of relatively small diameter. With particular regard to FIGS. 2 and 3, the drain fitting 11 includes a drain body 12 of generally hollow, tubular, cylindrical configuration. A flange 13 extends radially outwardly in annular fashion from the upper end of the drain body. The flange includes an annular recess 14 which is adapted to retain a strainer (not shown). The upper portion of the exterior of the drain body 12 is furnished with threads 16 which are adapted to engage a like threaded exterior nut 17.

Figure 2:
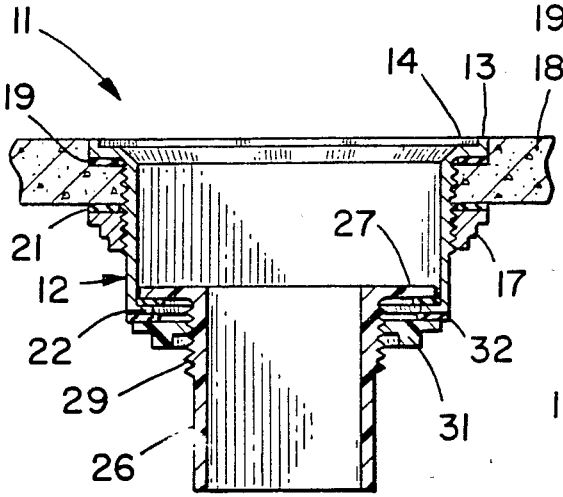
FIG. 2 is a cross-sectional elevation of the drain assembly of the present invention.
Figure 3:
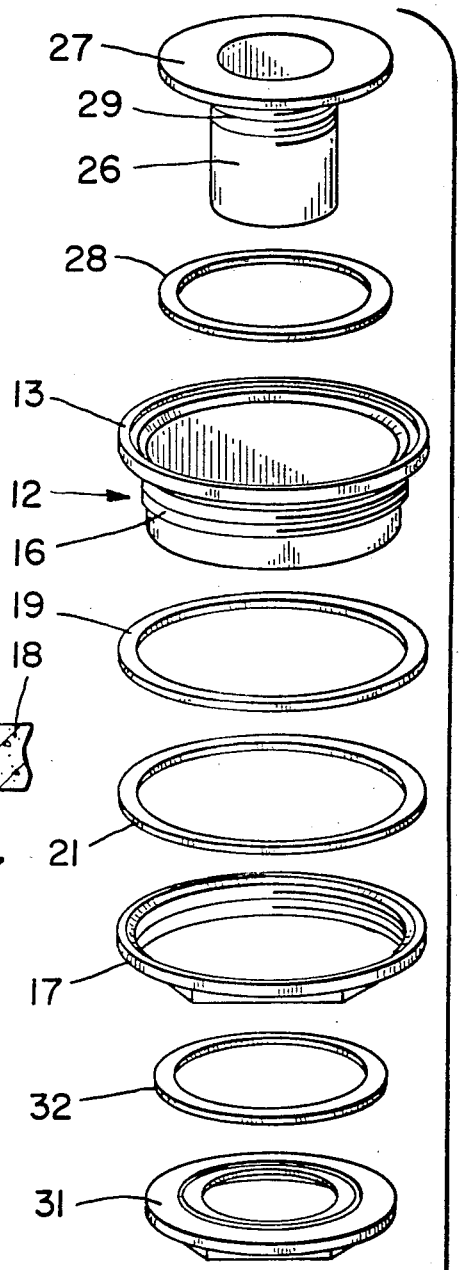
FIG. 3 is an exploded view of the drain assembly of the present invention.

As shown in FIG. 2, the drain body 12 extends through a hole in a floor 18, with the flange 13 received in an annular recess about the hole and disposed generally flush with the upper surface of the floor. A packing ring 19 is also disposed in the annular recess with the flange 13, and another packing ring 21 is disposed directly superjacent of the nut 17. The nut is tightened compressively to secure the drain body in the hole and to form a seal with the floor.

The drain body 12 is also provided with a lower flange 22 extending radially inwardly from the lower end thereof. The flange 22 is relatively wide, and defines a narrower lower bore opening for the drain body.

A salient feature of the present invention is the provision of a tubular, hollow coupling member 26. The member 26 is furnished with a coupling flange 27 which is generally equal in diameter to the inner diameter of the drain body. The coupling flange 27 is adapted to overlay the drain lower flange 22 in confronting relationship, with a sealing ring 28 disposed therebetween. The upper portion of the coupling member is also provided with external threads 29 which secure a nut 31 thereabout. The nut is adapted to impinge upon the lower end of the drain body, with a sealing ring 32 disposed therebetween.

It should be noted that the tubular portion of the coupling member 26 is equal in diameter to a standard waste pipe diameter which is smaller than the diameter for which most large drain bodies are designed. The coupling member may be joined to a like waste pipe by conventional means, such as a sleeve secured with a suitable adhesive, or the like. The nut 31 is tightened to compressively engage the flanges 27 and 22, and the lower end of the drain, to effect a seal with the coupling member and thus with the waste pipe system.

It may be appreciated that the present invention also provides greater flexibility in the makeup of plumbing systems. For example, a series of coupling members may be manufactured for each drain body model, each coupling member reducing to a differing standard waste pipe diameter. Each of the coupling members is provided with the same flange 27, so that a leakproof seal may be formed with the drain, no matter what the diameter of the waste pipe being connected.

I claim:

1. A floor drain which is adapted to fit a narrow waste pipe, including; a drain body having a bore of a first diameter, an upper flange extending radially outwardly from the upper end of said drain body, a lower flange extending radially inwardly from the lower end of said drain body to define a lower bore opening, a coupling member including a tubular portion having a second diameter, said second diameter being substantially equal to the diameter of a narrower waste pipe, a coupling flange extending from the upper end of said coupling member and adapted to overlay said lower flange in confronting fashion, first thread means for compressively engaging said floor surface and securing said drain body, and second thread means for sealing together said coupling flange and said lower flange.

2. The floor drain of claim 1, wherein said first thread means includes external threads formed on said drain body, and a first nut engaging said external threads and compressively engaging said floor in conjunction with said upper flange.

3. The floor drain of claim 1, wherein said second thread means includes external threads formed on said coupling member, and a second nut for engaging said external threads on said coupling member and for impinging on the lower end of said drain body.

4. The floor drain of claim 1, wherein said coupling flange is substantially equal in diameter to said first diameter.

5. The floor drain of claim 1, further including a plurality of coupling members, each having a tubular portion provided with differing diameters equal to standard diameter waste pipes, and each having a coupling flange generally equal to said first diameter.

6. The floor drain of claim 1, wherein said upper flange is adapted to be disposed flush with the upper surface of said floor.

7. The floor drain of claim 1, further including packing means disposed between said coupling flange and said lower flange.

8. The floor drain of claim 1, further including packing means disposed between said upper flange and said floor.

* * * * *